US008723137B1

(12) United States Patent
Hwu et al.

(10) Patent No.: US 8,723,137 B1
(45) Date of Patent: May 13, 2014

(54) HYBRID MAGNET FOR VACUUM ELECTRONIC DEVICE

(71) Applicants: Ruey-Jen Hwu, Salt Lake City, UT (US); Jishi Ren, Ottawa (CA); Jehn-Huar Chern, Salt Lake City, UT (US); Laurence P. Sadwick, Salt Lake City, UT (US)

(72) Inventors: Ruey-Jen Hwu, Salt Lake City, UT (US); Jishi Ren, Ottawa (CA); Jehn-Huar Chern, Salt Lake City, UT (US); Laurence P. Sadwick, Salt Lake City, UT (US)

(73) Assignee: InnoSys, Inc, Salt Lake City, UT (US)

( * ) Notice: Subject to any disclaimer, the term of this patent is extended or adjusted under 35 U.S.C. 154(b) by 0 days.

(21) Appl. No.: 14/051,665

(22) Filed: Oct. 11, 2013

Related U.S. Application Data

(60) Provisional application No. 61/714,864, filed on Oct. 17, 2012.

(51) Int. Cl.
*H01J 25/02* (2006.01)
*H01J 25/10* (2006.01)
*H01J 3/08* (2006.01)

(52) U.S. Cl.
USPC ..... 250/396 ML; 330/43; 315/5.16; 315/5.35; 315/5.39

(58) Field of Classification Search
USPC ..... 250/396 ML, 396 R, 526; 313/325, 442; 330/43, 44, 47, 63; 315/3.5, 5, 5.16, 315/5.35, 5.39, 5.11, 5.12, 39, 505, 507
See application file for complete search history.

(56) References Cited

U.S. PATENT DOCUMENTS

| | | | | |
|---|---|---|---|---|
| 3,265,978 | A * | 8/1966 | Clavier et al. | 330/4.7 |
| 3,433,706 | A * | 3/1969 | Detrixhe | 172/67 |
| 3,787,747 | A * | 1/1974 | Scott | 315/3.5 |
| 3,832,596 | A * | 8/1974 | Nelson et al. | 315/3.5 |
| 4,219,758 | A * | 8/1980 | Karp | 315/3.6 |
| 4,634,929 | A * | 1/1987 | Fischer | 315/5.39 |
| 6,734,734 | B2 * | 5/2004 | Goren et al. | 330/149 |
| 6,768,265 | B1 * | 7/2004 | Ives et al. | 315/5.16 |
| 6,847,168 | B1 * | 1/2005 | Ives et al. | 315/5.14 |
| 7,474,184 | B1 * | 1/2009 | Humphries et al. | 335/306 |
| 2004/0017255 | A1 * | 1/2004 | Goren et al. | 330/149 |
| 2011/0233397 | A1 * | 9/2011 | Barofsky et al. | 250/294 |

* cited by examiner

*Primary Examiner* — Bernard E Souw
(74) *Attorney, Agent, or Firm* — Hamilton, DeSanctis & Cha LLP

(57) ABSTRACT

Various embodiments of a vacuum electronic device, a hybrid magnet for a vacuum electronic device and methods of making a hybrid magnet for a vacuum electronic device are disclosed herein. In one embodiment, a hybrid magnet for a vacuum electronic device includes a first magnet, a second magnet positioned in spaced-apart relation with the first magnet and defining a gap between the first magnet and the second magnet, and a non-magnetic spacer positioned in a portion of the gap between the first magnet and second magnet and connected to the first magnet and the second magnet.

19 Claims, 4 Drawing Sheets

HYBRID MAGNET FOR VACUUM ELECTRONIC DEVICE

BACKGROUND

Microwave electronic devices, sometimes referred to as radio frequency (RF) devices or vacuum electronic devices (VEDs), are used in systems with important functions such as radar and high speed communications systems, etc. For example, a traveling wave tube is a vacuum electronic device that may be used as an amplifier to increase the gain, power or some other characteristic of an RF signal, that is, of electromagnetic waves typically within a range of around 0.3 GHz to above 300 GHz. An RF signal to be amplified is passed through the device, where it interacts with and is amplified by an electron beam. The electron beam may be generated at the cathode of an electron gun, which is typically heated, for example to about 1000 degrees Celsius. Electrons are emitted from the heated cathode by thermionic emission and are drawn through a cavity or tunnel in the VED to a collector by a high voltage bias, and is typically focused by a magnetic field. If the electron beam directly touches the structure of the VED, it can destroy the VED by overheating and melting the structure.

Magnets are placed around the housing or barrel of the VED, typically along the length of the VED, to focus and steer the electron beam. As illustrated in FIG. 1, magnets (e.g., 10) designed for use around and along a cylindrical VED housing may include a circular cutout 12 to fit around the VED housing, and may be fabricated in pieces 14 and 16 for convenient mounting on the VED housing.

The RF signal enters and exits the VED through ports which can interfere with the magnets. For example, if the RF ports are located on the sides of the housing, they prevent magnets from being placed around the housing at that point. One typical solution is to omit magnets at the RF port locations along the VED housing, but this can allow the electron beam to drift as it passes the RF ports. Another typical solution is the use of a horseshoe magnet 20 with a cutout 22. The cutout 22 allows the horseshoe magnet 20 to slide over the VED housing during assembly, and is aligned with the RF port so that a waveguide or coaxial or other connector can be connected to the RF port at the cutout 22. However, because of the cutout 22 the horseshoe magnet 20 creates an asymmetrical magnetic field which can deflect the electron beam away from the center axis of the beam tunnel in the VED and allow it to approach structures within the VED.

SUMMARY

Various embodiments of a vacuum electronic device, a hybrid magnet for a vacuum electronic device and methods of making a hybrid magnet for a vacuum electronic device are disclosed herein. In one embodiment, a hybrid magnet for a vacuum electronic device includes a first magnet, a second magnet positioned in spaced-apart relation with the first magnet and defining a gap between the first magnet and the second magnet, and a non-magnetic spacer positioned in a portion of the gap between the first magnet and second magnet and connected to the first magnet and the second magnet.

The hybrid magnet may be formed in a variety of shapes and configurations. In one embodiment, the hybrid magnet is in a C shape, with a disk segment on either side of the non-magnetic spacer, with a central axial tunnel between the disk segments for a vacuum electronic device housing, and with an RF port opening opposite the non-magnetic spacer between the disk segments. In this embodiment, the hybrid magnet creates a symmetrical magnetic field around the tunnel.

In some embodiments, the first magnet and second magnet are axially magnetized with respect to the hybrid magnet.

In some embodiments, the first magnet, the second magnet and the non-magnetic spacer have substantially the same axial coefficient of thermal expansion (CTE).

An embodiment of a method for making a hybrid magnet for a vacuum electronic device includes forming a first magnetic disk segment and a second magnetic disk segment from a disk magnet, and connecting a non-magnetic spacer between the first and second magnetic disk segments, leaving an RF port entry opposite the non-magnetic spacer between the first and second magnetic disk segments. The disk magnet may comprise a ring magnet having a centered axial passage to reduce machining. Some embodiments of the method include shaping an outer edge of the non-magnetic spacer to match the outer edge profile of a the first and second magnetic disk segments. In some embodiments, the segments are formed by cutting using wire electric discharge machining (EDM).

In some embodiments, the disk magnet is axially magnetized before forming the disk segments. The disk segments and non-magnetic spacer may be joined by applying epoxy to bonding surfaces and thermally curing the epoxy. The first and second magnetic disk segments and the non-magnetic spacer may have substantially the same axial coefficient of thermal expansion to maintain the bond across thermal expansion cycles.

An embodiment of a vacuum electronic device using a hybrid magnet includes a vacuum housing, an electron gun at a first end of the vacuum housing, a collector at a second end of the vacuum housing, a number of annular magnets positioned along and around the vacuum housing with the vacuum housing passing through axial tunnels through the plurality of annular magnets, and at least one hybrid magnet positioned around the vacuum housing. The hybrid magnet has an annular shape with an axial tunnel for the vacuum housing, an RF port opening on a first side and a non-magnetic spacer symmetrically positioned on a second side around the axial tunnel. The hybrid magnet is axially magnetized, and produces a substantially symmetrical magnetic field around the vacuum housing.

This summary provides only a general outline of some exemplary embodiments. Many other objects, features, advantages and other embodiments will become more fully apparent from the following detailed description, the appended claims and the accompanying drawings.

BRIEF DESCRIPTION OF THE DRAWINGS

A further understanding of the various exemplary embodiments may be realized by reference to the figures which are described in remaining portions of the specification. In the figures, like reference numerals may be used throughout several drawings to refer to similar components.

DESCRIPTION

The drawings and description, in general, disclose various embodiments of a hybrid magnet for use in focusing and/or steering an electron beam in a vacuum electronic device (VED), as well as a vacuum electronic device employing hybrid magnets at RF ports or at any locations as desired. The hybrid magnets provide access to the barrel or body of a vacuum electronic device, while continuing to provide a symmetrical magnetic field.

Figure 1:
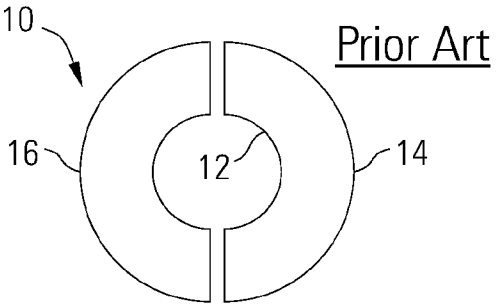
FIG. 1 depicts a side view of a prior art magnet for a cylindrical barrel VED.
Figure 2:
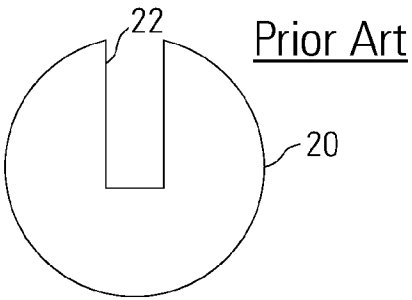
FIG. 2 depicts a side view of a prior art horseshoe magnet for a VED.
Figure 3:
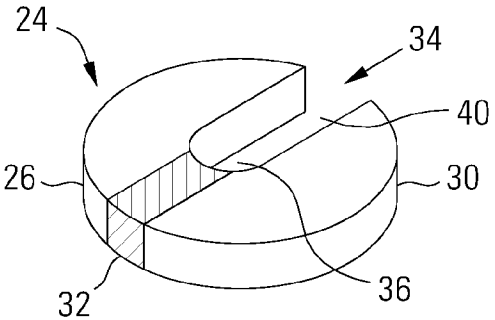
FIG. 3 depicts an example of a hybrid magnet that may be used with a vacuum electronic device.

Turning now to FIG. 3, an example of a hybrid magnet 24 that may be used in a vacuum electronic device is illustrated. This example embodiment is adapted for use with a vacuum electronic device having a cylindrical housing. The hybrid magnet 24 includes a pair of magnetic disk segments 26 and 30, separated by a non-magnetic spacer 32 which is mounted in a gap 34 between the disk segments 26 and 30. A tunnel 36 is formed for a vacuum electronic device housing between the disk segments 26 and 30, with an RF port opening 40 in the gap 34 between the disk segments 26 and 30 opposite the non-magnetic spacer 32. The RF port opening 40 provides a passage to the vacuum electronic device housing for an RF input such as a waveguide or an RF coaxial connector. The non-magnetic spacer 32 symmetrically balances the RF port opening 40, so that a magnetic field generated by the magnetic disk segments 26 and 30 is symmetrical around the tunnel 36. The hybrid magnet 24 thus provides an RF port opening 40, while maintaining a symmetrical magnetic field to guide and center an electron beam along the tunnel 36, in contrast to a horseshoe magnet 20 which produces an asymmetrical magnetic field. While some embodiments are described herein as having a "C" shape, they include one or more non-magnetic spacers and are thus not equivalent to a horseshoe magnet 20, thereby reducing any asymmetry of the magnetic field. The term "symmetrical magnetic field" is used herein when referring to the hybrid magnet 24 to indicate that the magnetic field is symmetrical about a plane or about some other geometry, and not necessarily that the magnetic field is symmetrical about the axis or tunnel 36. A ring magnet generally creates a symmetrical magnetic field about its axis. When the ring magnet is adapted with an air gap for an RF port or other purpose, creating a horseshoe magnet, the axial symmetry is destroyed by the air gap. Some embodiments of the hybrid magnet described herein provide two gaps the magnetic material, the air gap and the non-magnetic spacer. The resulting C-shaped hybrid magnet creates a symmetrical field about a plane, with better symmetry than a horseshoe magnet.

Figure 4:
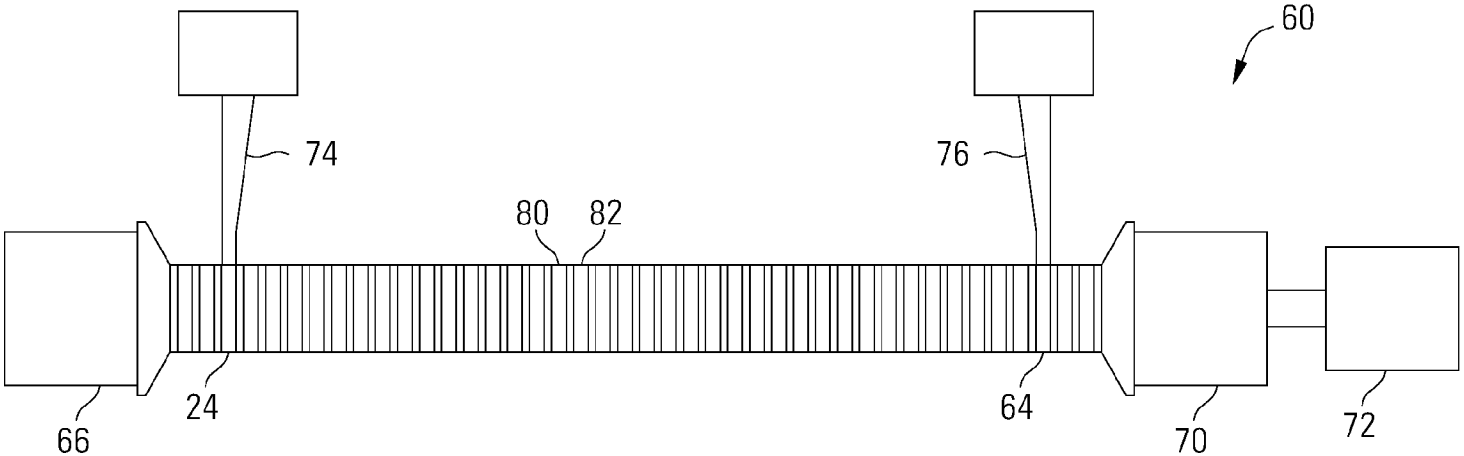
FIG. 4 depicts a side view of a VED with side-facing RF ports, electron gun, collector and ion pump.

Turning now to FIG. 4, an example of a vacuum electronic device 60 employing hybrid magnets 24 and 64 is illustrated. The vacuum electronic device 60 may be any type of high frequency device, such as a traveling wave tube containing a slow wave structure to amplify a radio frequency (RF) signal. The vacuum electronic device 60 is not limited to any particular type of RF device. It may have any shape or size, and may be adapted to perform any desired function. Thus, the term "barrel" is used generically herein to refer to the main vacuum housing of a vacuum electronic device, because the examples shown herein have a cylindrical housing along which steering magnets are placed. However, the vacuum electronic device 60 may have a square or rectangular cross-section or any other configuration.

In general, the hybrid magnets 24 and 64 have a symmetrical magnetic structure, with non-magnetic spacers mirroring RF port openings or other openings. The hybrid magnets 24 and 64 are therefore able to be placed along the barrel of the vacuum electronic device 60 to include magnetic elements at the position of RF openings, maintaining a magnetic field at that position, while remaining magnetically symmetrical despite the opening. Just as the housing of the vacuum electronic device 60 may have any of a number of shapes and configurations, so the hybrid magnets 24 and 64 may be adapted to any of a number of differently configured vacuum electronic device housings.

The vacuum electronic device 60 includes an electron gun 66 and collector 70 at opposite ends of the barrel of the vacuum electronic device 60. (The electron gun 66 and collector 70 may be swapped to opposite ends of the vacuum electronic device 60, and are not limited to the placement illustrated in FIG. 4.) An ion pump 72 or other vacuum forming device is also connected to the vacuum electronic device 60 to evacuate the vacuum electronic device 60 and provide a very low pressure environment within the barrel or housing of the vacuum electronic device 60. (Details of the electron gun 66, collector 70 and ion pump 72 are not shown or described, as the vacuum electronic device 60 is not limited to use with any particular type of electron beam and vacuum equipment and any such equipment now known or developed in the future may be used.)

An RF input 74 and RF output 76 are connected at the sides near the ends of the vacuum electronic device 60. For example, hollow waveguides having RF-transparent windows to maintain a vacuum in the vacuum electronic device 60 may be used. Magnets are placed along the barrel of the vacuum electronic device 60 to produce a magnetic field and steer an electron beam between the electron gun 66 and collector 70. For example, a linear periodic array of permanent magnets (e.g., 80 and 82) in ring or toroidal form are placed around or adjacent the housing of the vacuum electronic device 60. Note that the vacuum electronic device 60 is not limited to the number of magnets (e.g., 80 and 82) illustrated in FIG. 4.

Figure 5:
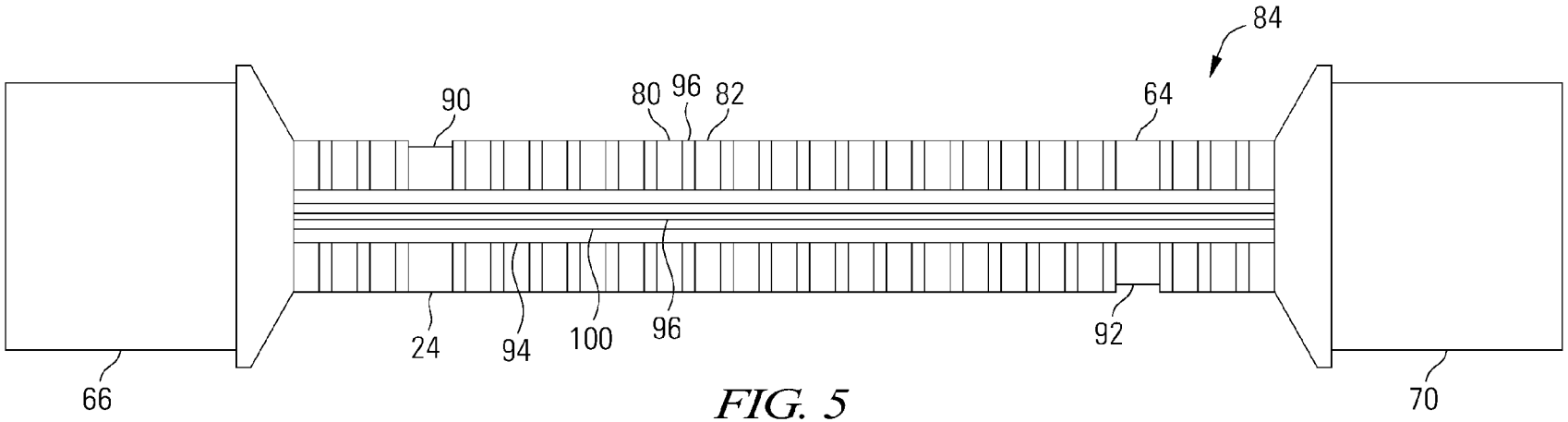
FIG. 5 depicts a cross-sectional side view of an example of a VED with opposing RF ports with an embodiment of a hybrid magnet mounted adjacent the RF ports.
Figure 6:
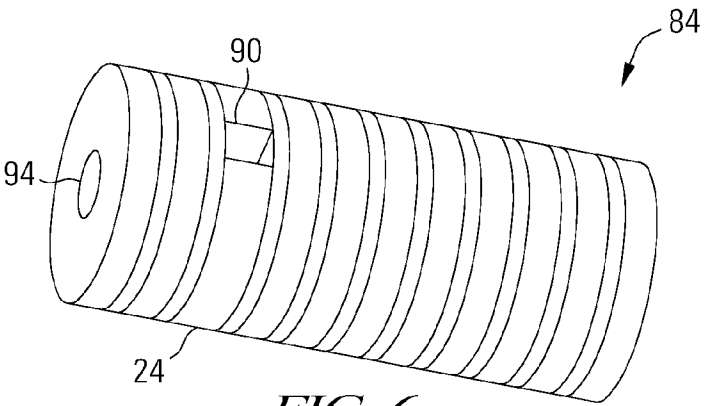
FIG. 6 depicts a perspective view of a portion of the VED and example hybrid magnet with RF port channel.

A cross-sectional view of a portion of a vacuum electronic device 84 is illustrated in FIG. 5, and a perspective view of a smaller portion of the vacuum electronic device 84 is illustrated in FIG. 6. In this embodiment, the vacuum electronic device 84 is shortened and the number of periodic permanent magnets (e.g., 80 and 82) is reduced, showing the vacuum electronic device 84 in more detail. A pair of RF ports 90 and 92 are provided to allow RF inputs and outputs to be connected to the vacuum electronic device 84. In this embodiment, the RF ports 90 and 92 are at opposite sides of the vacuum electronic device 84. RF ports (e.g., 90 and 92) may be located and oriented in any desired manner based upon the type of vacuum electronic device and the desired operating characteristics. Hybrid magnets 24 and 64 are positioned at the RF ports 90 and 92, contributing to the magnetic field along the barrel 94 while leaving the RF ports 90 and 92 open and unimpeded for insertion of the RF inputs 74 and 76. In one embodiment, the magnets (e.g., 80, 82, 24 and 64) are axially magnetized, with a north magnetic pole on one face and a south magnetic pole on the opposite face, and the center of the magnetic field flowing along the center axis of the magnets (e.g., 80, 82, 24 and 64) and therefore along the electron beam tunnel 96 of the vacuum electronic device 84.

To assemble the vacuum electronic device 84, ring or toroidal magnets are slid together along the barrel 94, for example placing oppositely polarized faces adjacent. The magnets (e.g., 80, 82, 24 and 64) may be sized to fit snugly over the barrel 94 to provide heat dissipation for the vacuum electronic device 84. In some periodic permanent magnet embodiments, adjacent magnet faces having the same polarity are positioned facing each other, with a pole piece or spacer (e.g., 96) between magnets. For example, the north pole face of one magnet is placed adjacent the north pole face of the neighboring magnet. With this arrangement in which adjacent magnet faces have the same polarization (e.g., N-S S-N N-S for three adjacent magnets), the zero field point is set at the axis center of spacers. This minimizes the influence of irregularities in the periodic permanent magnets such as any absent pole pieces or an abnormal pitch length over the RF port. (For example, see FIG. 5, where the width or pitch length of the RF port 90 and thus of the hybrid magnet 24 in one example embodiment is greater than that of the ring magnets, e.g., 80.) In other embodiments, the north pole face of one magnet (e.g., 80) is placed adjacent the south pole face of the neighboring magnet (e.g., 82). Spacers (e.g., 96) or pole pieces may be placed between magnets (e.g., 80 and 82) if desired. However, the vacuum electronic device 84 is not limited to this magnet polarization or this assembly configuration. Magnets (e.g., 80, 82, 24 and 64) may have a polarization or magnetization other than axial magnetization of the example. The hybrid magnets 24 and 64 may be slid over the barrel 94 from the end or from the side. The hybrid magnets 24 and 64 may be sized to match the width of the RF inputs 74 and 76, or may have the same width as other permanent periodic magnets (e.g., 80 and 82).

During operation, the ion pump 72 produces a vacuum within the vacuum electronic device 84, the electron gun 66 is heated and a large bias voltage is applied across the electron gun 66 and collector 70. This generates an electron beam between the cathode of the electron gun 66 and the collector 70. In other embodiments, a voltage bias may be applied between a cathode and an anode at opposite ends of the beam tunnel 96 to generate an electron beam. The electron beam is focused or contained in the tunnel along the beam tunnel 96 by a magnetic field generated by the periodic permanent magnets (e.g., 80 and 82) and the hybrid magnets 24 and 64. An RF signal is applied at the RF input 74 and is coupled to a slow wave structure 100 in the vacuum electronic device 84. The vacuum electronic device 84 may be adapted to cause the RF signal to travel along the length of the slow wave structure 100 at about the same speed as the electron beam, maximizing the coupling between the electron beam and the RF signal. Energy from the electron beam is coupled to the RF signal, amplifying the RF signal, and the amplified RF signal is decoupled from the slow wave structure to the RF output 76 before the electron beam reaches the collector 70.

Turning now to FIGS. 7-14, an example process of manufacturing a hybrid magnet 24 for a vacuum electronic device will be described. A ring-shaped magnet 120 may be used to form a hybrid magnet 24. A disk-shaped magnet may also be used, although this will require additional machining to remove the center region to form the tunnel 36. As discussed above, the thickness of the ring-shaped magnet 120 may be selected based on the size of the RF input 74, in order that the RF input 74 fits within the RF port opening 40 formed by the hybrid magnet 24. The thickness of the hybrid magnet 24 may be adapted to provide a snug or slack fit for the RF input 74, as desired. For a wide RF input 74, multiple hybrid magnets 24 may be stacked along the barrel 94 of the vacuum electronic device 84. In this case, the thickness of the hybrid magnet 24 may be adapted such that a particular number of stacked hybrid magnets 24 produce the desired width of RF port opening 40.

Figure 8:
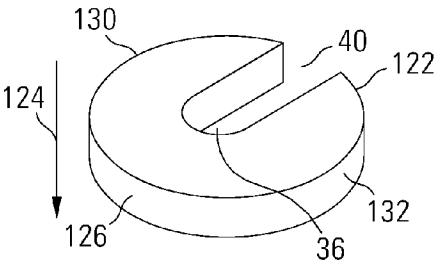
FIG. 8 depicts a perspective view of a C magnet in an example operation of forming an embodiment of a hybrid magnet for a vacuum electronic device.
Figure 7:
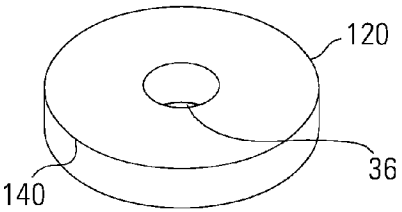
FIG. 7 depicts a perspective view of a ring magnet in an example operation of forming an embodiment of a hybrid magnet for a vacuum electronic device.
Figure 11:
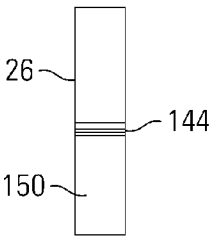
FIG. 11 depicts an end view of half of an embodiment of a split magnet.
Figure 10:
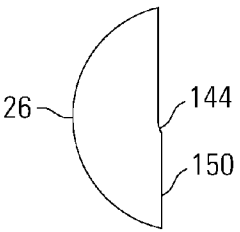
FIG. 10 depicts a side view of half of an embodiment of a split magnet.
Figure 14:
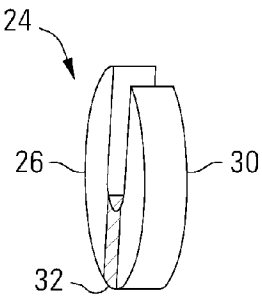
FIG. 14 depicts a perspective view of an embodiment of a hybrid magnet for a vacuum electronic device.
Figure 13:
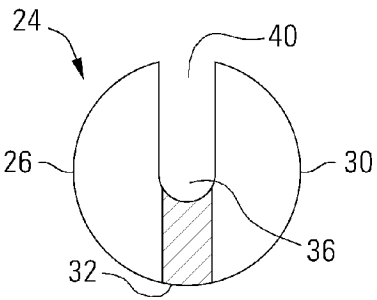
FIG. 13 depicts a side view of an embodiment of a hybrid magnet for a vacuum electronic device.
Figure 12:
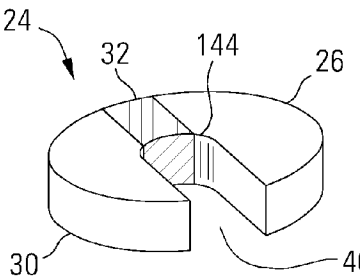
FIG. 12 depicts a perspective view of an embodiment of a hybrid magnet for a vacuum electronic device.

The ring-shaped magnet 120 may be isotropically cold pressed and then sintered to generate the mechanical strength for subsequent steps, including machining and magnetization. In other embodiments, the ring-shaped magnet 120 may be formed by casting. In one embodiment, machining is completed before magnetizing the magnet. This includes, for example, machining away a portion of the ring-shaped magnet 120 to form a C-shaped magnet 122 as illustrated in FIG. 8 before axially magnetizing the C-shaped magnet 122. The portion of the ring-shaped magnet 120 machined away may have a width substantially equal to the diameter of the VED barrel 94 and of the tunnel 36, and substantially equal to the width of the RF input 74, if it is to fit snugly within the RF port opening 40 in the hybrid magnet 24. In one embodiment for a traveling wave tube vacuum electronic device, the C-shaped magnet 122 (and therefore the hybrid magnet 24) is axially charged or magnetized in a direction 124 parallel with the tunnel 36, although the hybrid magnet 24 is not limited to this polarization. The ring-shaped magnet 120 may be machined using any suitable technique, including wire electric discharge machining (EDM) or grinding. In wire EDM, the tool forms a first electrode and the magnet or workpiece forms a second electrode, and electrical current discharges between the two electrodes remove material from the workpiece. Various materials may be used for the ring-shaped magnet 120, depending on requirements such as thermal performance, magnetic field strength, etc. The ring-shaped magnet 120 can be formed any type of material that produces a magnetic field suitable for the target vacuum electronic device, using materials such as iron, aluminum, nickel, cobalt, copper, titanium, etc. For example, samarium cobalt (SmCo) and neodymium iron boron (NdFeB) may be used in a variety of compositions, with various different compositions used to optimize performance and different operating temperatures.

The C-shaped magnet 122 (or the ring-shaped magnet 120 in some embodiments) may be magnetized in any suitable manner, such as by heating the materials then cooling them at a controlled rate within a magnetic field. Other embodiments may include ferrite or ceramic magnets, or neodymium magnets. The hybrid magnet 24 is not limited to these types of magnets, manufacturing or magnetizing processes, and may be adapted to any suitable materials or processes now known or that may be developed in the future.

Figure 9:
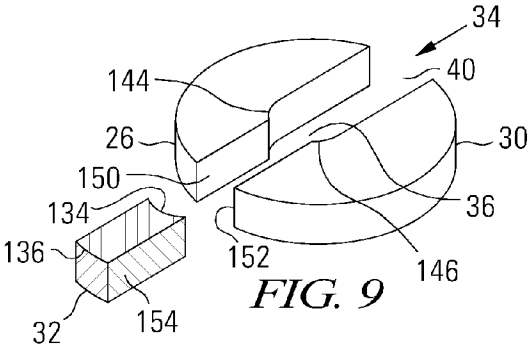
FIG. 9 depicts a perspective view of a split magnet and non-magnetic spacer in an example operation of forming an embodiment of a hybrid magnet for a vacuum electronic device.

As illustrated in FIG. 9, the C-shaped magnet 122 is machined to form a pair of disk segments 26 and 30. (Disk segment 26 is shown in side profile in FIG. 10 and edge profile in FIG. 11.) The term "disk segment" is used herein to refer to a portion of a disk, or a region bounded by a chord and an arc. The disk segments 26 and 30 may be formed by machining away a base section 126 of the C-shaped magnet 122 between the two arms 130 and 132 with a width equal to that of the non-magnetic spacer 32. The non-magnetic spacer 32 is machined to have an inner radius 134 matching that of the tunnel 36 in the ring-shaped magnet 120 and an outer edge 136 matching that of the outer edge 140 of the ring-shaped magnet 120. Note that the non-magnetic spacer 32 may have the same width as the RF port opening 40 and the tunnel 36. In other embodiments, as in the embodiments illustrated in FIGS. 7-14, the width of the non-magnetic spacer 32 (and the width of the portion of the base section 126 that is machined away) is less than the diameter of the RF port opening 40 and the width of the tunnel 36. This forms a curved ridge 144 and 146 on each disk segment 26 and 30 that can be helpful when aligning the non-magnetic spacer 32 with the disk segments 26 and 30 during assembly of the hybrid magnet 24.

When machining the C-shaped magnet 122 to form the magnetic disk segments 26 and 30, flat edge or bonding surfaces 150 and 152 are formed, parallel to each other, to which the non-magnetic spacer 32 is connected. Flat bonding surfaces (e.g., 154) are formed on the non-magnetic spacer 32 corresponding with the bonding surfaces 150 and 152 on the magnetic disk segments 26 and 30.

The non-magnetic spacer 32 is machined or otherwise formed from any of a number of suitable materials, including metals and non-metals. Light weight materials may be advantageous for some purposes, such as in vacuum electronic devices used in space communications. Examples of metals that may be used for the non-magnetic spacer 32 include titanium, vanadium, zirconium, rhodium, and niobium. If the non-magnetic spacer 32 is polymer based, it may be more difficult to bond to disk segments 26 and 30 machined from samarium cobalt (SmCo) than those machined from neodymium iron boron (NdFeB). The term "non-magnetic" is used herein to indicate that the non-magnetic spacer 32 produces substantially no magnetic field, although in some embodiments the non-magnetic spacer 32 may produce a magnetic field that is weaker than that produced by the disk segments 26 and 30. Any reduction in magnetic field strength from the non-magnetic spacer 32 will tend to steer the electron beam along the beam tunnel 96 more precisely than a horseshoe magnet 20. Magnetic fields from the non-magnetic spacer 32 may be avoided by using a material that cannot be magnetized, or by using a material that is susceptible to magnetization but that is not magnetized.

The disk segments 26 and 30 and non-magnetic spacer 32 are also selected for bondability and to match the Coefficient of Thermal Expansion (CTE), particularly in the magnetic alignment direction 124. Note that the CTE of magnetic materials tends to be very different in the magnetic alignment direction 124 than in directions perpendicular to the magnetic alignment direction 124.

In some embodiments, the disk segments 26 and 30 and non-magnetic spacer 32 are bonded together using an epoxy that is applied to bonding surfaces (e.g., 150 and 152), either on the disk segments 26 and 30 or non-magnetic spacer 32 or both. For example, a very thin layer between about 0.003" and 0.005" may be used to bond the disk segments 26 and 30 and non-magnetic spacer 32. Thermal curing may be used to cure the epoxy, without exceeding the maximum operation temperature of the disk segments 26 and 30 and non-magnetic spacer 32. Pressure may be applied through the entire curing process. For example, a fixture may be used during bonding to keep the disk segments 26 and 30 and non-magnetic spacer 32 concentric and flat while applying pressure to the joints. The completed hybrid magnet 24, as illustrated in perspective views in FIGS. 12 and 14 and in side view in FIG. 13.

Figure 15:
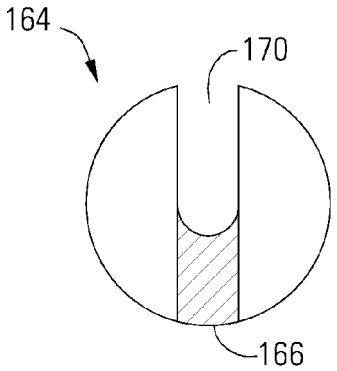
FIG. 15 depicts a side view of an embodiment of a hybrid magnet for a vacuum electronic device in which the inner radius is substantially equal to the width of the air gap for an RF port.
Figure 16:
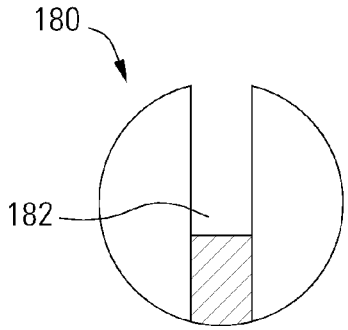
FIG. 16 depicts a side view of an embodiment of a hybrid magnet for a vacuum electronic device which has a flat-bottomed central tunnel.
Figure 17:
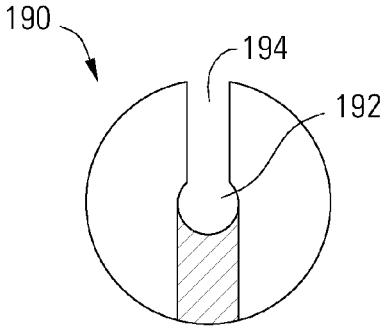
FIG. 17 depicts a side view of an embodiment of a hybrid magnet for a vacuum electronic device in which the inner radius is greater than the width of the air gap for an RF port.
Figure 18:
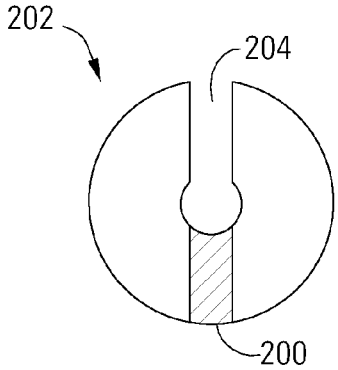
FIG. 18 depicts a side view of an embodiment of a hybrid magnet for a vacuum electronic device in which the inner radius is greater than the width of the air gap for an RF port with a non-magnetic spacer having the same width as the air gap.

Turning now to FIG. 15, another embodiment of a hybrid magnet 164 is illustrated which is similar in most respects to the hybrid magnet 24 of previous embodiments, but which omits the ridges 144 and 146. In this embodiment, the non-magnetic spacer 166 has the same width as the RF port 170. Another embodiment of a hybrid magnet 180 illustrated in FIG. 16 has a square tunnel 182, simplifying fabrication, and may be used with a vacuum electronic device having either a round or square barrel 94. In another embodiment illustrated in FIG. 17, a hybrid magnet 190 may have a tunnel 192 having a radius that is greater than the width of the air gap 194 for an RF port. Note that the radius of the tunnel 192 and the width of the air gap 194 may be adapted as desired in various embodiments, with the drawings merely providing non-limiting examples. As illustrated in FIG. 18, the width of the non-magnetic spacer 200 in a hybrid magnet 202 may be matched to the width of the air gap 204 to increase the symmetry of the magnetic field. In other embodiments, the width of the non-magnetic spacer and air gap may be different as shown in FIG. 17. The thickness of the hybrid magnet when viewed from the side is not limited to the examples illustrated in the drawings, but may be adapted as desired. As discussed above, the hybrid magnet may be adapted to vacuum electronic devices having a wide variety of shapes and configurations. The hybrid magnet provides one or more openings for RF inputs or other purposes, while maintaining a symmetrical magnetic field.

Figure 19:
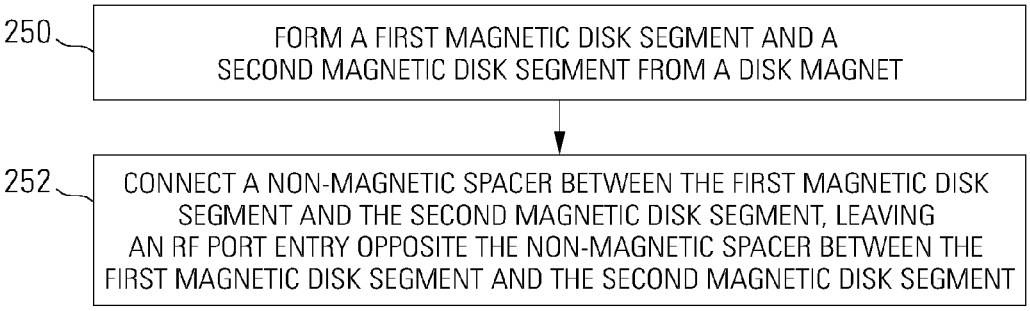
FIG. 19 depicts an example of a method of manufacturing a hybrid magnet.

Turning now to FIG. 19, a method of manufacturing a hybrid magnet for a vacuum electronic device is summarized. The method includes forming a pair of magnetic disk segments from a disk magnet (block 250), and connecting a non-magnetic spacer between the first magnetic disk segment and the second magnetic disk segment (block 252). An RF port entry is provided opposite the non-magnetic spacer between the first magnetic disk segment and the second magnetic disk segment. In some embodiments of the method, the disk magnet comprises a ring magnet having a centered axial passage. Some or all of the elements of the hybrid magnet may be formed using wire electric discharge machining following axial magnetization. Elements of the hybrid magnet may be bonded using thermally cured epoxy. Again, hybrid magnets as disclosed herein are not limited to this particular method of fabrication, and may be fabricated using other suitable methods if desired.

While illustrative embodiments have been described in detail herein, it is to be understood that the concepts disclosed herein may be otherwise variously embodied and employed, and that the appended claims are intended to be construed to include such variations, except as limited by the prior art.

What is claimed is:

1. A hybrid magnet for a vacuum electronic device comprising:

a first magnet magnetic disk segment;

a second magnet magnetic disk segment positioned in spaced-apart relation with the first magnet magnetic disk segment and defining a gap between the first magnet magnetic disk segment and the second magnet magnetic disk segment; and a non-magnetic spacer positioned in a portion of the gap between the first magnet magnetic disk segment and the second magnet magnetic disk segment and connected to the first magnet magnetic disk segment and the second magnet magnetic disk segment, wherein another portion of the gap between the first magnetic disk segment and the second magnetic disk segment comprises an RF port opening in the hybrid magnet.

2. The hybrid magnet of claim 1, wherein the first magnet and the second magnet each comprise a flat edge surface, and wherein the flat edge surfaces are positioned parallel to each other.

3. The hybrid magnet of claim 1, wherein a portion of the gap comprises a tunnel for a vacuum electronic device housing.

4. The hybrid magnet of claim 3, wherein a remainder of the gap excluding the non-magnetic spacer and the tunnel comprises the RF port opening in the hybrid magnet.

5. The hybrid magnet of claim 4, wherein the non-magnetic spacer and the RF port opening are substantially symmetrical around the tunnel.

6. The hybrid magnet of claim 5, wherein the hybrid magnet creates a symmetrical magnetic field around the tunnel.

7. The hybrid magnet of claim 3, wherein the first magnet and the second magnet are symmetrical around the tunnel.

8. The hybrid magnet of claim 1, wherein the first magnet, second magnet and non-magnetic spacer in the hybrid magnet form a C shape.

9. The hybrid magnet of claim 1, wherein the first magnet and second magnet are axially magnetized with respect to the hybrid magnet.

10. The hybrid magnet of claim 1, wherein the first magnet, the second magnet and the non-magnetic spacer comprise a substantially same axial coefficient of thermal expansion.

11. A method of manufacturing a hybrid magnet for a vacuum electronic device, the method comprising:

forming a first magnetic disk segment and a second magnetic disk segment from a disk magnet; and connecting a non-magnetic spacer between the first magnetic disk segment and the second magnetic disk segment, leaving an RF port entry opposite the non-magnetic spacer between the first magnetic disk segment and the second magnetic disk segment.

12. The method of claim 11, wherein the disk magnet comprises a ring magnet having a centered axial passage.

13. The method of claim 11, further comprising shaping an outer edge of the non-magnetic spacer to match a profile of a first magnetic disk segment outer edge and a second magnetic disk segment outer edge.

14. The method of claim 11, wherein the forming comprises cutting the disk magnet using wire electric discharge machining.

15. The method of claim 11, further comprising axially magnetizing the disk magnet before the forming.

16. The method of claim 11, wherein the connecting comprises applying an epoxy on a bonding surface between the first magnetic disk segment and the non-magnetic spacer and on a second bonding surface between the second magnetic disk segment and the non-magnetic spacer.

17. The method of claim 16, further comprising thermally curing the epoxy.

18. The method of claim 11, wherein the first magnetic disk segment, the second magnetic disk segment and the non-magnetic spacer comprise a substantially same axial coefficient of thermal expansion.

19. A vacuum electronic device comprising:

a vacuum housing;

an electron gun at a first end of the vacuum housing;

a collector at a second end of the vacuum housing;

a plurality of annular magnets positioned along and around the vacuum housing with the vacuum housing passing through axial tunnels through the plurality of annular magnets; and at least one hybrid magnet positioned around the vacuum housing, the at least one hybrid magnet having an annular shape with an axial tunnel for the vacuum housing, an RF port opening on a first side and a non-magnetic spacer symmetrically positioned on a second side around the axial tunnel, the at least one hybrid magnet being axially magnetized, wherein the at least one hybrid magnet produces a substantially symmetrical magnetic field around the vacuum housing.

* * * * *